US012790793B2

(12) United States Patent
Weber et al.

(10) Patent No.: US 12,790,793 B2
(45) Date of Patent: Nov. 10, 2026

(54) CHANGE SYSTEM FOR WEAR PARTS OF AN EXCAVATOR BUCKET OF AN EARTHMOVING MACHINE

(71) Applicant: LIEBHERR-MINING EQUIPMENT COLMAR SAS, Colmar Cedex (FR)

(72) Inventors: Gerard Weber, Meyenheim (FR); Martial Vicq, Bischwihr (FR)

(73) Assignee: LIEBHERR-MINING EQUIPMENT COLMAR SAS, Colmar Cedex (FR)

( * ) Notice: Subject to any disclaimer, the term of this patent is extended or adjusted under 35 U.S.C. 154(b) by 1016 days.

(21) Appl. No.: 17/995,087

(22) PCT Filed: Mar. 26, 2021

(86) PCT No.: PCT/EP2021/057867
§ 371 (c)(1),
(2) Date: Sep. 29, 2022

(87) PCT Pub. No.: WO2021/198050
PCT Pub. Date: Oct. 7, 2021

(65) Prior Publication Data

US 2023/0175237 A1 Jun. 8, 2023

(30) Foreign Application Priority Data

Apr. 1, 2020 (DE) ..... 10 2020 109 010.2

(51) Int. Cl.
*E02F 9/28* (2006.01)

(52) U.S. Cl.
CPC ..... *E02F 9/2833* (2013.01); *E02F 9/2883* (2013.01); *E02F 9/2825* (2013.01)

(58) Field of Classification Search
None
See application file for complete search history.

(56) References Cited

U.S. PATENT DOCUMENTS 3,371,437 A * 3/1968 Wilson ..... E02F 9/2825 411/401
4,231,173 A 11/1980 Davis
(Continued)

FOREIGN PATENT DOCUMENTS

CA 2778973 A1 * 5/2011 ..... E02F 9/2833
FR 2878871 A1 6/2006

OTHER PUBLICATIONS

ISA European Patent Office, International Search Report Issued in Application No. PCT/EP2021/057867, Jun. 25, 2021, WIPO, 2 pages.

*Primary Examiner* — Christopher J Sebesta
*Assistant Examiner* — Alfred H Tsui
(74) *Attorney, Agent, or Firm* — McCoy Russell LLP

(57) ABSTRACT

The invention relates to a change system for wear parts of an excavator bucket of an earthmoving machine, comprising a carrier structure which can be fastened to or is formed on the excavator bucket and which has a projection and also an exchange part with a pocket-like cavity for releasably plugging the exchange part onto the projection of the carrier structure, wherein, to secure the exchange part on the carrier structure, there is provided at least one connection member which is connected to the carrier structure via a first connecting mechanism and to the exchange part via a second connecting mechanism physically separated from the first connecting mechanism, wherein at least one of the two connecting mechanisms is a releasable connection.

15 Claims, 4 Drawing Sheets

(56) References Cited

U.S. PATENT DOCUMENTS

| | | | | |
|---|---|---|---|---|
| 4,413,432 | A * | 11/1983 | Bierwith | E02F 9/2825 37/456 |
| 5,713,145 | A | 2/1998 | Ruvang | |
| 6,209,238 | B1 | 4/2001 | Ruvang | |
| 2009/0277050 | A1 | 11/2009 | Ollinger, IV et al. | |
| 2011/0072693 | A1* | 3/2011 | Knight | E02F 9/2825 37/456 |
| 2014/0352182 | A1 | 12/2014 | LaHood et al. | |
| 2017/0022689 | A1 | 1/2017 | Tasovski | |
| 2017/0073939 | A1 | 3/2017 | Bjerke et al. | |
| 2017/0370076 | A1 | 12/2017 | Campomanes et al. | |

* cited by examiner

CHANGE SYSTEM FOR WEAR PARTS OF AN EXCAVATOR BUCKET OF AN EARTHMOVING MACHINE

CROSS REFERENCE TO RELATED APPLICATIONS

The present application is a U.S. National Phase of International Application No. PCT/EP2021/057867 entitled "CHANGE SYSTEM FOR WEAR PARTS OF AN EXCAVATOR BUCKET OF AN EARTHMOVING MACHINE," and filed on Mar. 26, 2021. International Application No. PCT/EP2021/057867 claims priority to German Patent Application No. 10 2020 109 010.2 filed on Apr. 1, 2020. The entire contents of each of the above-listed applications are hereby incorporated by reference for all purposes.

TECHNICAL FIELD

The invention relates to a change system for wear parts of an excavator bucket of an earthmoving machine, comprising a carrier structure which can be fastened to or is formed on the excavator bucket and which has a projection and also an exchange part with a pocket-like cavity, which exchange part can, by means of the cavity, be releasably plugged onto the carrier structure or onto the projection of the carrier structure formed there.

BACKGROUND AND SUMMARY

Excavator buckets of earthmoving machines are subject to extreme loads from the dug material during digging work. This is even more true of earthmoving machines in the field of mining, i.e. for surface and underground mining. The buckets used there consist of a main structure made of cast steel, which are provided at wear-critical points with exchangeable wear parts as protection, which parts can then be replaced after a certain operating period. Examples of such wear parts include bucket teeth and shields in the region of the cutting edge or cutting walls of the bucket. Individual adapters for the teeth can also be of an exchangeable design. Since these wear parts are exchanged as required, their fastening to the main carrier must also be designed in a releasable manner.

The above-described systems are known on the market as so-called "ground engaging tools (GET)". Prominent here is the design of corresponding tooth adapters on the lip of the excavator bucket, which are used to receive the actual teeth. The pushed-on teeth are fixed on the adapter by means of a socket pin, which is pushed either horizontally or vertically through the adapter. In addition to the adapter, the pin used must also withstand the occurring loads, and must therefore have relatively large dimensions. However, the disadvantage of this is that the size of the pin requires a correspondingly large pin bore hole within the tooth and also within the adapter, which can cause a weakening of the adapter structure (or tooth).

In addition, during operation, vertical or horizontal pins are subject to shear forces which can generally lead to a deformation of the pin. However, a deformed pin makes it more difficult to separate the pin connection and thus to exchange the teeth. If the pin deformation is exacerbated by the collection of bulk material and a compacting of the collected dirt in the region of the pin connection, it is possible that the pin cannot be removed at all, or only with great effort.

Furthermore, the production of the aforementioned adapters and tooth parts is associated with certain difficulties. During the production of tooth parts and adapters as cast parts, the bore holes are a critical point in the cooling process since they concentrate heat. This can lead to cooling cracks or damage during the casting process on the sand core. Holes in the structures additionally induce stress concentrations, which adversely affect the fatigue life of the parts.

Against this background, the present invention is concerned with optimizing change systems of the generic type for wear parts of an excavator bucket in order to overcome the aforementioned disadvantages.

Proposed is therefore a change system for wear parts of an excavator bucket of an earthmoving machine, primarily for earthmoving machines in the field of mining Such change systems are also called "ground engaging tools" (GET) in the technical jargon. The change system relates above all to the arrangement of a bucket tooth on an adapter of the excavator bucket. However, the invention should in no way be limited to such a connection between adapter and tooth, and can easily be applied to the arrangement of tooth parts directly on the lip of the excavator bucket. The invention is also suitable for fastening the tooth adapters themselves on the lip of the excavator bucket. Finally, the invention can also be applied to the fastening of so-called shields (covers) to the lip, more particularly in the region between the tooth adapters or on the side walls of the excavator bucket. To represent the different possibilities, we refer consistently hereinafter to a carrier structure and an exchange part releasably fastened thereto.

According to the invention, it is provided to provide at least one additional connecting member for securing or fixing the exchange part on the carrier structure, which additional connecting member is connected to the carrier structure via a first connection mechanism, and to the exchange part via a further second connecting mechanism, which is physically separated from the first connection mechanism. At least one of the two connection mechanisms is based on a releasable connection in order to ensure the exchangeability of the exchange part.

Thanks to this measure, significant modifications (such as bore holes) to the carrier structure or exchange part, which adversely affect the component durability can be dispensed with. Instead, additional material in the form of the connecting member is used for the connection. Implementing independent closure mechanisms for the connection between connecting member and carrier structure on the one hand, and between exchange part and connecting member on the other, also makes the system more resistant to occurring shear stresses.

One of the connection mechanisms can be a permanent connection, for example in the form of a welded or adhesive connection. A part combining the elements can also be designed as a single piece.

According to a preferred embodiment, one of these connection mechanisms sits on the circumferential side on either the carrier structure or exchange part. However, the circumferential-side fastening on the carrier structure is preferred, because the dimensions of the carrier structure are usually smaller than the dimensions of the exchange part plugged onto the projection of the carrier structure. One of the connection mechanisms is preferably designed in a clip-like manner, for example in a U-shape like a wedge groove, a groove and tenon connection or a dovetail connection. According to a preferred embodiment, the connecting member thus at least partially engages around the carrier structure. Ideally, the circumference of the connecting member sitting on the carrier structure approximately corresponds to the circumference of the exchange part in the connection region, i.e. the outer faces of connecting member and exchange part are approximately flush.

According to a further preferred embodiment, the second connection mechanism develops a tensile force on the connecting member, as a result of which said connecting member is pulled preferably axially towards the exchange part.

The first connection mechanism can for example be formed by one or more longitudinal grooves or vertical grooves into which corresponding guide projections of the part to be connected engage. Ideally, the orientation of the grooves is selected in accordance with the tensile force of the second connection mechanism.

According to a preferred embodiment, it is provided for the carrier structure to have one or more wedge-shaped longitudinal grooves into which one or more wedge-like guide projections of the connecting member engage. As a result of the design as longitudinal grooves, it is thereby possible for the connecting member to be displaced in the longitudinal direction on the circumference of the carrier structure, more particularly towards the plugged-on exchange part. Because of the wedge-shaped design of the grooves, the groove width is variable, and therefore ideally narrows towards the exchange part. An axial displacement of the connecting member towards the exchange part therefore leads to an increase in the force fit between groove and guide projection.

Alternatively, it can as well be provided for the longitudinal grooves to instead be formed in the region of the connecting member, more particularly on the inner side of the clip shape of the connecting member. Corresponding guide projections are then provided on the carrier structure. Here, too, the groove width narrows in the longitudinal direction, for example, and therefore in the event of an axial movement of the connecting member towards the exchange part, a form fit between carrier structure and connecting member is achieved.

According to a preferred embodiment, the aforementioned axial movement of the connecting member is generated by the second connection mechanism between connecting member and exchange part. The tensile force exerted by the connection mechanism leads to the axial displacement of the connecting member and thus to the fixing of the first connection mechanism.

A suitable second connection mechanism would more particularly be a screw connection between exchange part and connecting member. This permits the tensile force to be continuously adjusted.

The screw connection can conceivably be designed with a retensioning device. For this purpose, it is conceivable to incorporate at least one elastic component, for example a ring or disc in the region of the screw connection in order to compensate for deformations by means of the incorporated elasticity.

The screw connection between exchange part and connecting member may have one or more pocket-like recesses on the circumferential surface of the exchange part and/or on the surface of the connecting member. Components of the screw connection, such as the screw nuts or screw heads, can be embedded in such recesses in a protected manner, which more particularly reduces their contamination during the earthworks. Furthermore, components of the screw connection are prevented from projecting into the working region of the bucket in a disruptive manner.

According to a further embodiment, it can be provided for the connecting member to be secured to the carrier structure and/or to the exchange part via at least one additional securing element. Said securing element serves less for isostatic fixing and more as a pure safety precaution for the event that the first and/or second connection mechanism fails. In this case, the securing element should prevent the detachment of the connecting member.

Furthermore, the connecting member can, more particularly if it is arranged on the outer circumference of the carrier structure or of the connection part, additionally serve as wear protection for the carrier structure.

In addition to the change system according to the invention, the present invention relates to an excavator bucket for an earthmoving machine, more particularly for an earthmoving machine in the field of mining, having at least one change system according to the present invention. Further details relating to the excavator bucket can therefore be dispensed with, since they correspond in full to the statements made above about the change system.

The invention also relates to an earthmoving machine having an excavator bucket according to the invention. Further statements can therefore also be dispensed with.

BRIEF DESCRIPTION OF THE FIGURES

Further properties of the invention are to be described below based on a few exemplary embodiments, which are illustrated in the individual drawings, in which.

DETAILED DESCRIPTION

Figure 1:
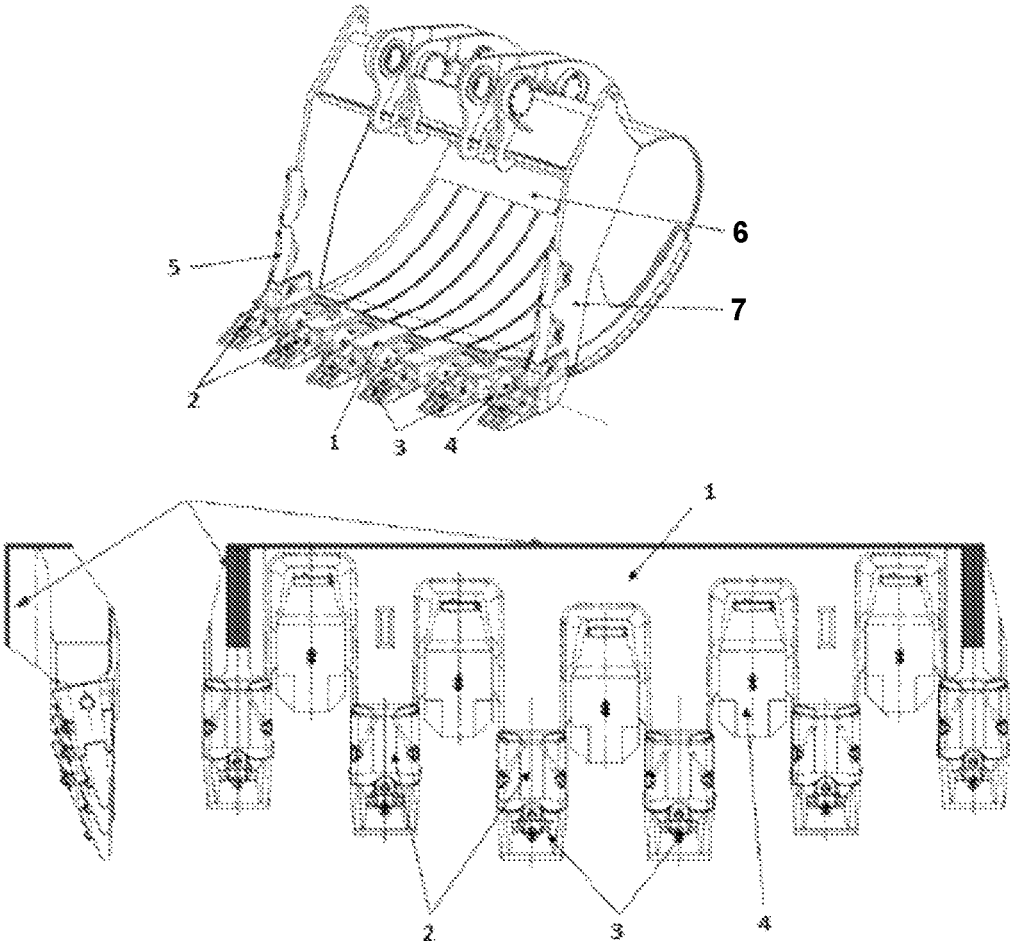
FIG. 1 shows a side view of the excavator bucket according to the invention including a detailed view of the lip of the excavator bucket

FIG. 1 provides a brief overview of the design of an excavator bucket for earthmoving machines of the mining equipment. The illustration shows the bucket in a perspective side view and a detail of the cutting edge of the bucket. The excavator bucket shown consists mainly of a main plate 6 with side plates 7 arranged thereon. On the front edge of the base plate 6 there is a lip 1, which represents the cutting plate of the excavator bucket. On this lip 1, a plurality of intermediate adapters 2 are mounted, which can also be releasably connected to the lip 1. The adapters 2 serve to receive the actual bucket teeth 3. Shields 4 can be mounted between the teeth 3 to protect against wear. The same can also be implemented for end edges of the side plates 7, on which corresponding wear protection elements 5 can be attached.

The present invention relates to the fastening of the individual components 2 to 5 to the excavator bucket. Hereinafter, the mechanism according to the invention is shown primarily based on the fastening of the bucket teeth 3 to the intermediate adapters 2. However, it is noted that the inventive concept is also suitable for fastening the adapters 2 to the lip 1 and for the direct fastening of any teeth 3 to the lip 1. The connection mechanism can also be used just as well for attaching the shields 4 to the lip 1, and the shields 5 to the side plates 7 of the bucket.

Figure 2:
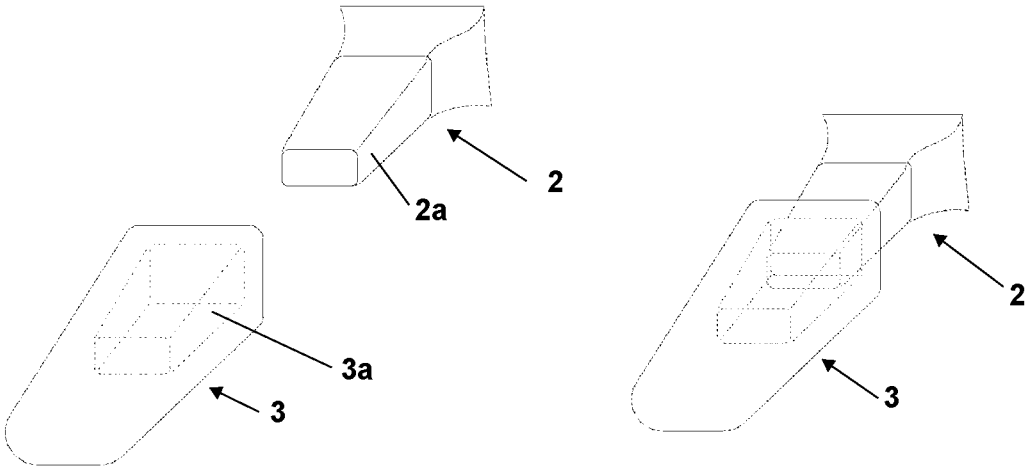
FIG. 2 shows a schematic view of the carrier structure including the exchange part in the form of a bucket tooth

FIG. 2 shows the principle of such a system consisting of the adapter 2 and a tooth 3 which can be plugged thereon. The adapter 2 forms a carrier structure with a corresponding projection 2*a* for receiving the tooth 3. The tooth 3 has a corresponding pocket-shaped cavity 3*a*, which approximately corresponds to the volume of the projection 2*a* of the carrier part 2. In the right-hand representation in FIG. 2, the tooth 3 is at least partially plugged onto the projection 2*a* of the carrier structure 2.

Figure 3:
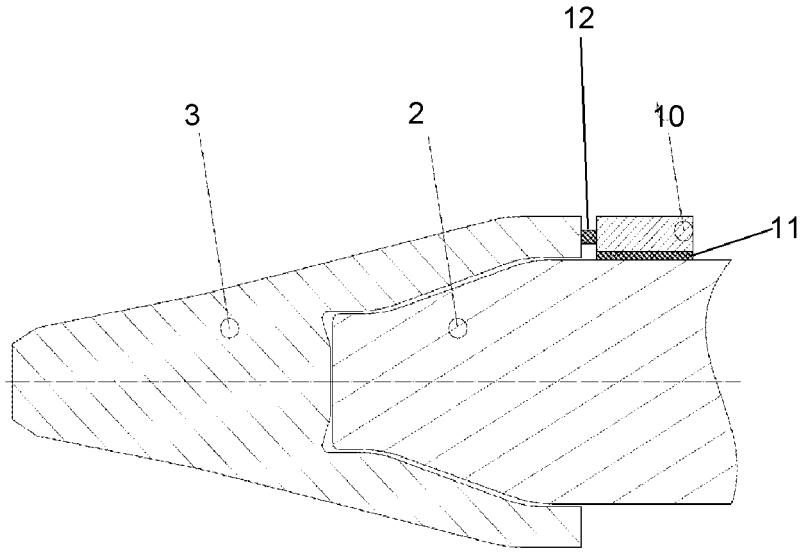
FIG. 3 shows a sectional view through the change system according to the invention including the novel connecting member

The tooth 3 is a wear part which must be exchanged from time to time. A releasable connection between the two components 2, 3 is therefore absolutely essential, which according to the present invention is realized with the aid of an additional component in the form of the connecting member 10. As shown in the embodiment in FIG. 3, this is attached on the circumferential side on the surface of the adapter 2 and is permanently connected to the adapter 2 by means of a first connection point 11. A second connection point 12, which is physically separated from the first connection point, is created between the first connecting member 10 and the tooth 3. Thanks to this measure, in particular the use of an additional connecting member 10, which is connected to the respective components 2, 3 by two separate connection points 11, 12, the disadvantages of the prior art can be largely overcome. More particularly, the shape of the carrier structure 2, i.e. of the adapter, can be kept ideal, since the structure of the carrier 2 no longer requires weakening bore holes. The same is naturally true for the design of the tooth 3.

Figure 4:
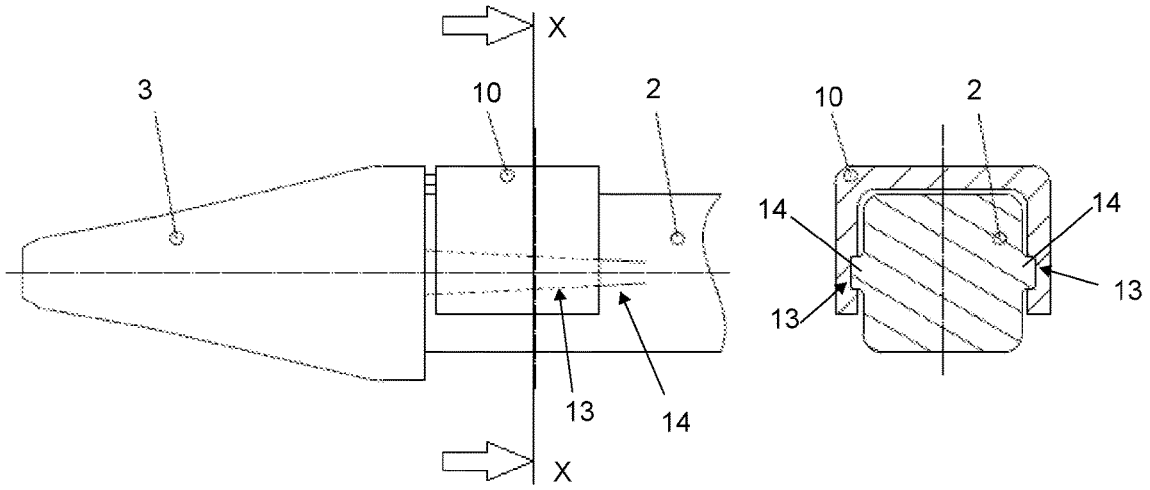
FIG. 4 shows the change system according to a first embodiment.

A concrete exemplary embodiment can be seen in FIG. 4, which shows a side view of the interface between tooth 3 and adapter 2 on the left and a section along the axis X-X on the right. In this embodiment, the connecting member 10 is designed as a kind of clip, which is placed on the surface of the adapter 2 and at least partially clasps the side walls of the adapter.

On the inside of the side walls of the connecting member 10, longitudinal grooves 13 are formed, which in the assembly position extend to the adapter 2 in the axial direction of the tooth 3. The groove width of the longitudinal grooves 13 increases towards the tooth 3. The opposite side faces of the adapter 2 are designed with complementary guide projections 15, which also extend in the axial direction of the tooth and the width of which also increases towards the tooth 3. For assembly, the connecting member 10 is placed on the adapter 2 and there is displaced in the axial direction towards the tooth 3. As a result of the somewhat smaller groove width as compared to the width of the guide projection 14, a force fit occurs between adapter 2 and connecting member 10 the closer the latter is moved towards the tooth 3.

The connection between the tooth 3 and the connecting member 10 is established by a further independent connection mechanism. This causes a tensile force on the connecting member 10, as a result of which the connecting member is pulled towards the tooth 3.

Figure 5:
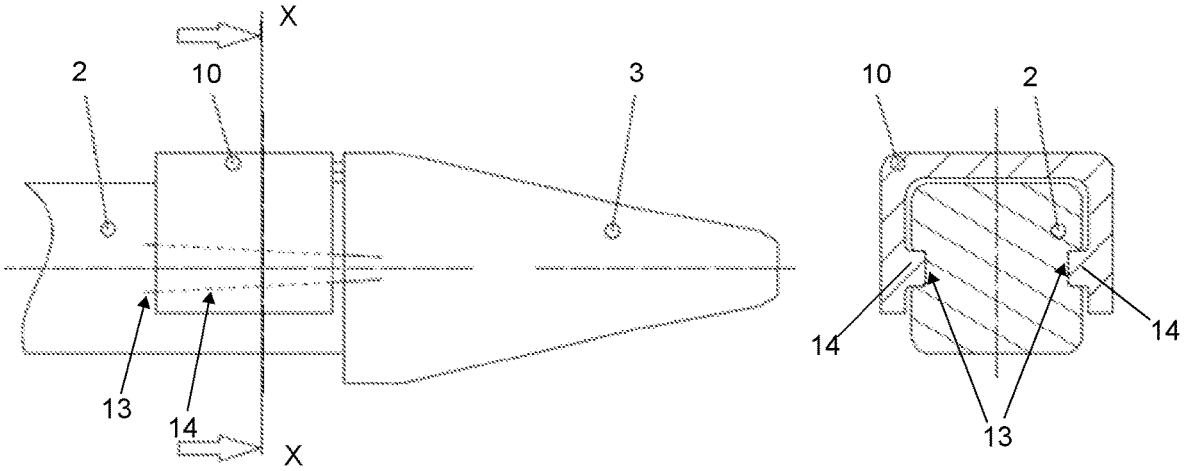
FIG. 5 shows the change system according to a second embodiment.

The arrangement and form of the guide projections and longitudinal grooves can also be slightly modified. According to FIG. 5, grooves 13 here are formed in the side regions of the adapter 2, while corresponding guide projections 14 are provided on the inside of the side walls of the connecting member 10. In contrast to the embodiment of FIG. 4, the groove or the guide projections here extend together in the axial direction towards the tooth 3, i.e. the width of the groove 13 and the guide projections 14 decreases towards the tooth. However, the assembly of the connecting member 10 is the same as that according to FIG. 4.

Figure 6:
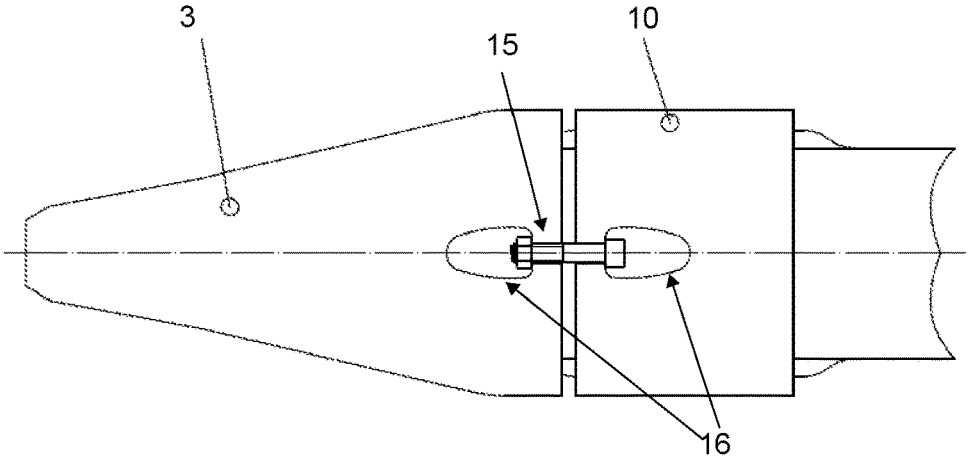
FIG. 6 shows a top view of the change system according to the invention.

The connection mechanism between connecting member 10 and tooth 3 can, as shown in FIG. 6, be designed as a screw connection 15. Tightening the screw connection 15 exerts a tensile force on the connecting member 10, and the connecting member is therefore pulled axially towards the tooth part 3.

It can also be seen from the embodiment in FIG. 6 that the individual components of the screw connection are embedded in corresponding recesses 16 on the outer diameter of the connecting member 10 and of the tooth part 3. As a result, they do not penetrate into the working space of the bucket and are also somewhat protected against the received bulk material.

Figure 7:
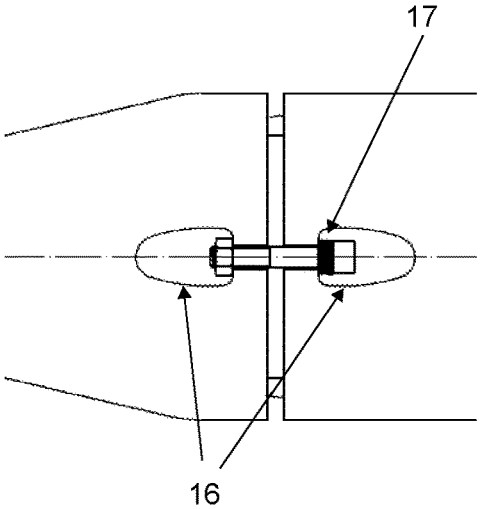
FIGS. 7-9 show various modifications of the exemplary embodiment according to FIG. 6
Figure 8:
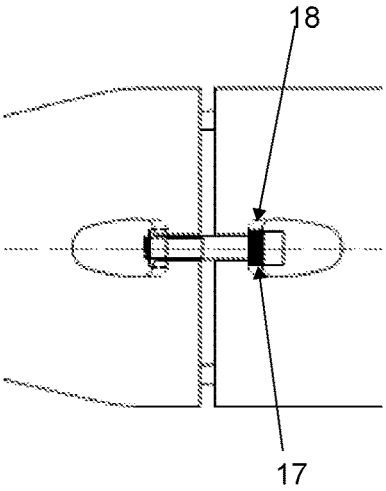
Figure 9:
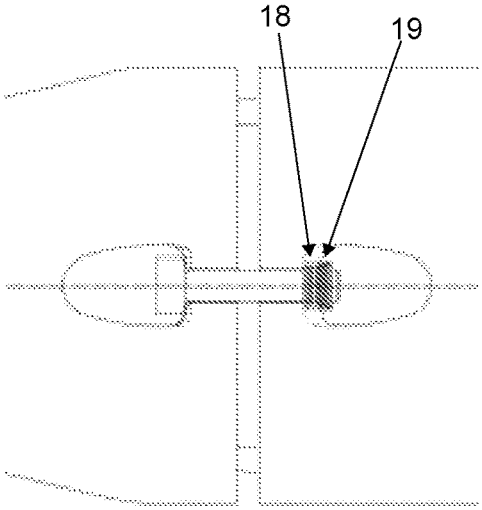

Minor modifications to the design of FIG. 6 are shown in FIGS. 7 to 9, in which the screw connection is configured with an additional retensioning device. According to FIG. 7, simple elastic discs 17 are used here, which are arranged between thread and screw head and which can, as a result of their elasticity, compensate for potential deformations. In the exemplary embodiment of FIG. 8, additional pockets 18 are created in the connecting member for placement of the discs 17. In the example of FIG. 9, an elastic ring 19 is additionally used.

The invention claimed is:

1. A change system for wear parts of an excavator bucket of an earthmoving machine, comprising:

an adapter which can be fastened to or is formed on the excavator bucket and which has a projection and an exchange part having a pocket-like cavity for releasably plugging the exchange part onto the projection of the adapter, wherein:

for securing the exchange part on the adapter, at least one connecting member is provided which is connected to the adapter via a first connection mechanism, and to the exchange part via a second connecting mechanism, which is physically separated from the first connection mechanism, wherein at least one of the first connection mechanism or the second connection mechanism is a releasable connection; and the at least one connecting member is in contact with a surface of the adapter and at least partially extends down side walls of the adapter;

wherein between the one connecting member and the exchange part, the second connection mechanism exerts a tensile force on the one connecting member; and wherein the first connection mechanism is formed by one or more longitudinal and/or vertical grooves, into which one or more guide projections of the part to be connected engage.

2. The change system according to claim 1, wherein one of the first connection mechanism or the second connection mechanism is a permanent connection.

3. The change system according to claim 1, wherein the connecting member sits on the circumferential side on the adapter.

4. The change system according to claim 1, wherein the adapter has one or more wedge-shaped longitudinal grooves into which one or more wedge-like guide projections of the connecting member engage, wherein the groove width ideally decreases towards the exchange part.

5. The change system according to claim 1, wherein the connecting member has one or more wedge-shaped longitudinal grooves into which one or more wedge-like guide projections of the adapter engage, wherein the groove width ideally decreases towards the exchange part.

6. The change system according to claim 1, wherein the second connection mechanism is a screw connection between connecting member and exchange part, by means of which screw connection a tensile force on the connection member towards the exchange part can be adjusted.

7. The change system according to claim 6, wherein the screw connection has a retensioning device.

8. The change system according to claim 6, wherein components of the screw connection are embedded in one or more pocket-like recesses of the circumferential surface of the exchange part and/or of the connecting member.

9. The change system according to claim 1, wherein the connecting member is connected to the adapter and/or to the exchange part via at least one additional securing means.

10. The change system according to claim 1, wherein the connecting member serves as wear protection for the exchange part and/or the adapter.

11. An excavator bucket for an earthmoving machine having at least one change system according to claim 1.

12. An earthmoving machine having an excavator bucket according to claim 11.

13. The change system according to claim 2, wherein one of the connection mechanisms is permanently connected using a welded or adhesive connection, or a single-piece design.

14. The change system according to claim 3, wherein the connecting member engages around the adapter at least partially in a clip-like manner.

15. The change system according to claim 1, wherein the second connection mechanism exerts a tensile force axially towards the exchange part.

* * * * *